US005370072A

United States Patent [19]

Adamski, Jr.

[11] Patent Number: 5,370,072

[45] Date of Patent: Dec. 6, 1994

[54] AUTOMATIC ALIGNMENT OF MATERIAL AND POSITIONING AT THE STITCH FORMING LOCATION

[75] Inventor: Maximilian Adamski, Jr., Tega Cay, S.C.

[73] Assignee: Union Special Corporation, Huntley, Ill.

[21] Appl. No.: 123,000

[22] Filed: Sep. 17, 1993

[51] Int. Cl.[5] ..... D05B 27/14

[52] U.S. Cl. ..... 112/262.3; 112/306; 112/322

[58] Field of Search ..... 112/63, 121.11, 262.3, 112/306, 308, 322, 318, 320

[56] References Cited

U.S. PATENT DOCUMENTS

| | | | |
|---|---|---|---|
| 3,933,106 | 1/1976 | Murray | 112/235 |
| 4,467,734 | 8/1984 | Rohr | 112/63 |
| 4,467,739 | 8/1984 | Hager et al. | 112/153 |
| 4,681,051 | 7/1987 | Kirch et al. | 112/306 |
| 4,744,319 | 5/1988 | Rohr | 112/306 |
| 4,823,716 | 4/1989 | Nakashima | 112/453 |
| 4,827,856 | 5/1989 | Rohr | 112/63 |
| 4,827,858 | 5/1989 | Horie et al. | 112/456 |
| 4,836,119 | 6/1989 | Siraco et al. | 112/306 |
| 4,924,787 | 5/1990 | Hansberry | 112/306 X |
| 4,998,493 | 3/1991 | Tanaka | 112/453 |
| 5,103,749 | 4/1992 | Geisselmann et al. | 112/306 X |
| 5,186,115 | 2/1993 | Rouleau et al. | 112/306 |

FOREIGN PATENT DOCUMENTS

| | | | |
|---|---|---|---|
| 0194182 | 9/1986 | European Pat. Off. . | |
| 2708338C2 | 9/1977 | Germany . | |
| 3917120C2 | 12/1989 | Germany . | |
| 4203426 | 9/1992 | Germany | 112/306 |
| 62-94195 | 4/1987 | Japan . | |
| 2218388 | 8/1990 | Japan | 112/306 |

OTHER PUBLICATIONS

English language, 1987 Derwent Publications Ltd. abstract of Japanese application JP-235699, Publication No. 62-94195.

*Primary Examiner*—Clifford D. Crowder
*Assistant Examiner*—Ismael Izaguirre
*Attorney, Agent, or Firm*—Willian Brinks Hofer Gilson & Lione

[57] ABSTRACT

A device for aligning the margin and leading edges of plies of material to be sewed and locating the aligned edges at the stitch forming location of a sewing machine. A first sensor for detecting the presence of the work piece and actuating a power driven gripper wheel in response to sensing the work piece. The power driven gripper wheel moves the work piece toward a second sensor that detects the work piece's margin edge and stops the power driven gripper wheel and actuates a power driven feeding wheel that feeds the work piece toward the stitch forming location. A third sensor detects the leading edge of the work piece as it approaches the stitch forming location. Control mechanisms are provided for commencing the sewing operation when the work material is at the stitch forming location.

23 Claims, 4 Drawing Sheets

AUTOMATIC ALIGNMENT OF MATERIAL AND POSITIONING AT THE STITCH FORMING LOCATION

CROSS-REFERENCES

The present application is related to copending application Ser. No. 07/967,419 filed Oct. 28, 1992, U.S. Pat. No. 5,251,557, entitled "Sewing Machine With an Edge Guiding Device to Guide One or More Plies of Material" by inventor Günter Rohr. U.S. Pat. No. 5,251,557 claims priority under the German application P 42 26 161.9 filed on Aug. 7, 1992. U.S. Pat. No. 5,251,557 is hereby incorporated herein by reference.

BACKGROUND OF THE INVENTION

The invention relates to a method and device for automatically aligning a work piece and positioning the aligned work piece at the stitch forming location of a sewing machine.

Prior art reference U.S. Pat. No. 4,467,734, discloses an edge guide and material advancing device for seaming a tubular work piece and forming a fold at its edge. The tubular work piece is manually located on the sewing machine work surface, such that it is in the proper location to commence the sewing operation. After positioning the work piece, but before commencing the sewing cycle, a work positioning device is activated which moves a portion of the material and creates a surplus of material near the work piece edge. The work piece edge is not moved from its original location. This surplus of material acts as a material buffer or storage zone which facilitates the aligning of the work piece edge by making possible a shifting of the work piece edge without having to shift the entire work piece in a direction transverse to the sewing direction. In accordance with the invention of this prior art patent the plies of material to be stitched are properly aligned and manually located at the stitch forming location by the sewing machine operator. Thus this prior art reference does not eliminate the tedious and time consuming task that is eliminated by the subject invention.

When seaming two plies of cloth together, a sewing machine operator manually aligns the leading and margin edges of the plies of cloth, in the relative positions that they are to have when stitched together, and then locates the aligned plies under the presser foot of the sewing machine. This is a very tedious and time consuming portion of a sewing operation and the operator must be highly skilled to perform this operation efficiently and properly.

For the foregoing reasons, there is a need for a device and method that will automatically align both the leading and the margin edges of the work piece and then position the work piece in the correct relationship at the stitch forming location prior to commencement of the sewing operation.

SUMMARY OF THE INVENTION

The present invention is directed to an apparatus and method that satisfies this need. The method of the present invention includes the step of placing a ply of material to be sewed under an edge guiding device where it is detected by a first sensor. The first sensor activates gripper wheels that cause the first ply of material to move in the direction normal to the direction of feed and cause the margin edge of the ply of material to move toward a second sensor. When the margin edge of the ply of material is sensed by the second sensor the gripper wheels are stopped. Ply feeding wheels are then actuated that function to feed the ply of material toward the stitch forming location. The leading edge of the ply is sensed when it arrives at a third sensing device that is located a known distance from the stitch forming location. The ply feeding wheels continue to feed the ply past the third sensing device toward the stitch forming location for a predetermined distance. When multiple plies of material are to be stitched together these steps are then repeated or performed simultaneously for the second and subsequent plies of material that are to be stitched together. When all plies of material are properly aligned and located at the stitch forming location the presser foot is lowered and the sewing operation commences. An advantage of this method is that a tedious and time consuming element of the sewing operation is accomplished automatically and quickly. This not only makes the sewing operation less tedious for the operator but permits less skilled operators to perform the sewing operation.

DETAILED DESCRIPTION OF THE PREFERRED EMBODIMENT

Figure 1:
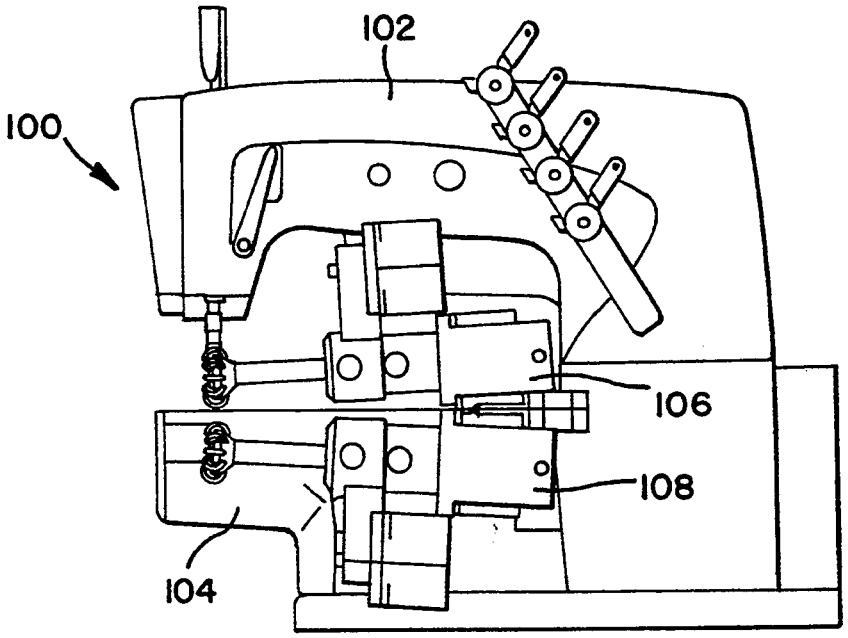
FIG. 1 is a front view of a sewing machine that has the automatic ply aligning and positioning mechanism of this invention mounted thereon.

There is shown in FIG. 1 a front view of a sewing machine 100 having a sewing head 102 and a base 104. The sewing machine 100 has an upper edge guiding device 106 and a lower edge guiding device 108 mounted thereon. The sensors and retractable plates, which are unique to this invention, are not visible in this view. The subject invention can be used with an over edge sewing machine or any other type sewing machine.

Figure 2:
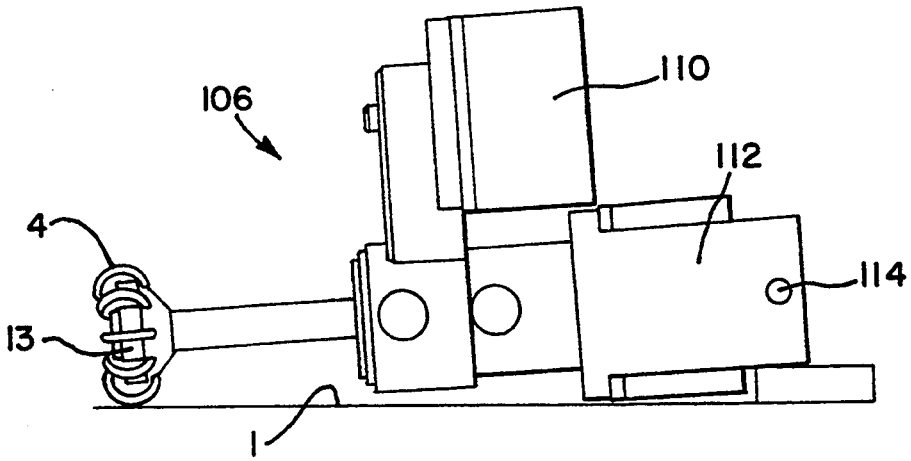
FIG. 2 is a front view of an edge guiding device of the type used in the automatic ply aligning and positioning mechanism of this invention.

An isolated view of upper edge guiding device 106 is shown in FIG. 2. The upper 106 and lower 108 edge guiding devices are structurally identical and thus only the upper will be discussed in detail. It should be noted that the edge guiding devices are disclosed in the above identified copending U.S. Pat. No. 5,251,557, and reference may be had to that U.S. Patent for a more complete disclosure of the structural components of these devices. It should also be noted that in U.S. Pat. No. 5,251,557 the edge guiding devices are elevated out of contact with the work piece and not actuated until the sewing operation commences and then function to maintain the margin edge of the material in proper alignment and feed the material along the line of feed at the proper rate. In the subject application the edge guiding devices perform the function of aligning the plies of material and then locating the aligned plies under the stitch forming mechanism. In accordance with this invention when the sewing process begins the edge guiding devices perform the same function as disclosed in the above referenced Application. The edge guiding device 106 has a first stepper motor 110 for driving the feeding wheel 13 that functions to advance the ply of material in the material feed direction and a second stepper motor 112 for driving the gripper wheels 4 that function to move the ply of material normal to the material feed direction. The stepper motors 110 and 112, which are conventional and not a part of this invention, can be controlled to rotate a specific number of rotations or fraction of a rotation. Thus, depending upon the diameter of the drive element and the drive ratios, a ply of material can be advanced a specific distance upon transmitting an actuation instruction to the stepper motor to run a specific number of steps.

The entire device 106 is supported at one end on a horizontal pivot shaft 114. The other end, which is the material engaging head of the device, rests on the main ply separator plate 1. The material engaging head can be lifted off the main ply separator plate 1 by pivoting the entire device about horizontal pivot shaft 114. The upper edge guiding device 106 can rely upon gravity or can include a mechanical device, such as a spring or an air cylinder, to assist in forcing the material engaging head into contact with the main ply separator plate 1. The lower edge guiding device 108 must include a mechanical device, such as a spring or air cylinder, to bias its material engaging head into contact with the main ply separator plate 1.

Figure 3:
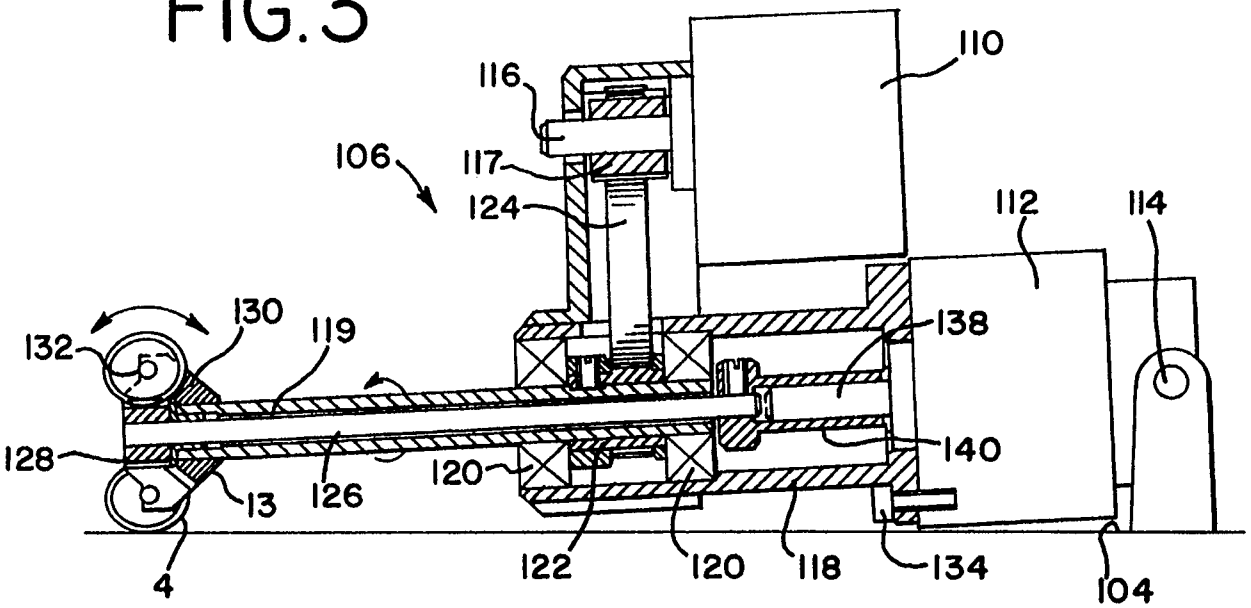
FIG. 3 is a cross section view of the edge guiding device seen in FIG. 2.

FIG. 3 is a cross section view of the upper edge guiding device 106 seen in FIG. 2. A housing 118 has the first stepper motor 110 mounted to its outer surface. First stepper motor 110 has an output shaft 116 with a pinion 117 secured thereto. A hollow shaft 119 is mounted for rotation by bearings 120 in the housing 118 and has a pinion 122 secured thereto. Pinion 122 is mechanically connected by way of a toothed belt 124 to pinion 117. Rotary drive is transmitted from stepper motor 110 through toothed belt 124 to the hollow shaft 119. A feeding wheel 13 is fixed to the free end of hollow shaft 119 and thus rotates therewith. The feeding wheel 13 has a plurality of openings 130 formed therein in which gripper wheels 4 are mounted for rotation on shafts 132. The peripheral edges of gripper wheels 4 are in driving engagement with worm gear 128 and are caused to rotate thereby. Worm gear 128 is secured to the free end of shaft 126 that is mounted for rotation within the hollow shaft 119.

The housing 118 is secured to one end of second stepper motor 112 by bolts 134. The other end of second stepper motor 112 is pivotally mounted to the base 104 of the sewing machine 100 about a pivot shaft 114. The output shaft 138 of second stepper motor 112 is secured to shaft 126 by a coupler 140. The feeding wheel 13 of upper edge guiding device 106 can be lifted off main ply separator plate 1 by pivoting the edge guiding device 106 upwardly about shaft 114.

Figure 4:
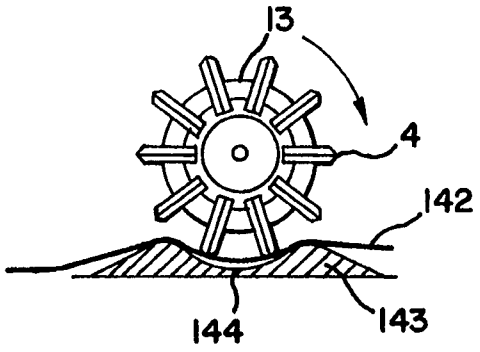
FIG. 4 is an end view of the feeding and gripper wheel head of the edge guiding device seen in FIG. 2.

FIG. 4 which is an end view of the feeding wheel 13 includes a ply of material designated 142 between the peripheral edge of feeding wheel 13 and a reaction plate 143. Reaction plate 143 has a cylindrical shaped concave surface 144 that cooperates with the peripheral edges of gripper wheels 4 to grip the material 142 so as to feed it in the precise amount intended. As a result of the concave shape of surface 144 a plurality of gripper wheels 4 can be in engagement with the material 142 at the same time which enhance the control and precision of this feed.

The sensors used in the device of this invention are of the retroreflector type in which emitted rays are reflected back to the sensor. The emitted rays are directed at a highly reflective surface, or a surface to which reflective tape has been applied. When the ply of material moves into the area where the rays are directed there is a change in the rays that are reflected back to the sensor. This change is detected by the sensor and the change is transmitted to the control system.

Diffuse type sensors could also be used. Diffuse type sensors recognize characteristics of a particular type of surface that they are intended to sense and do not require the presence of a highly reflective surface.

An example of the invention, in which a first top ply of material and a second bottom ply of material are to be stitched together, will be discussed with referring to FIGS. 5 and 6. This example can be applied to a sewing operation in which a single ply of material is being stitched or an operation in which more than two plies of material are being stitched together.

Figure 5:
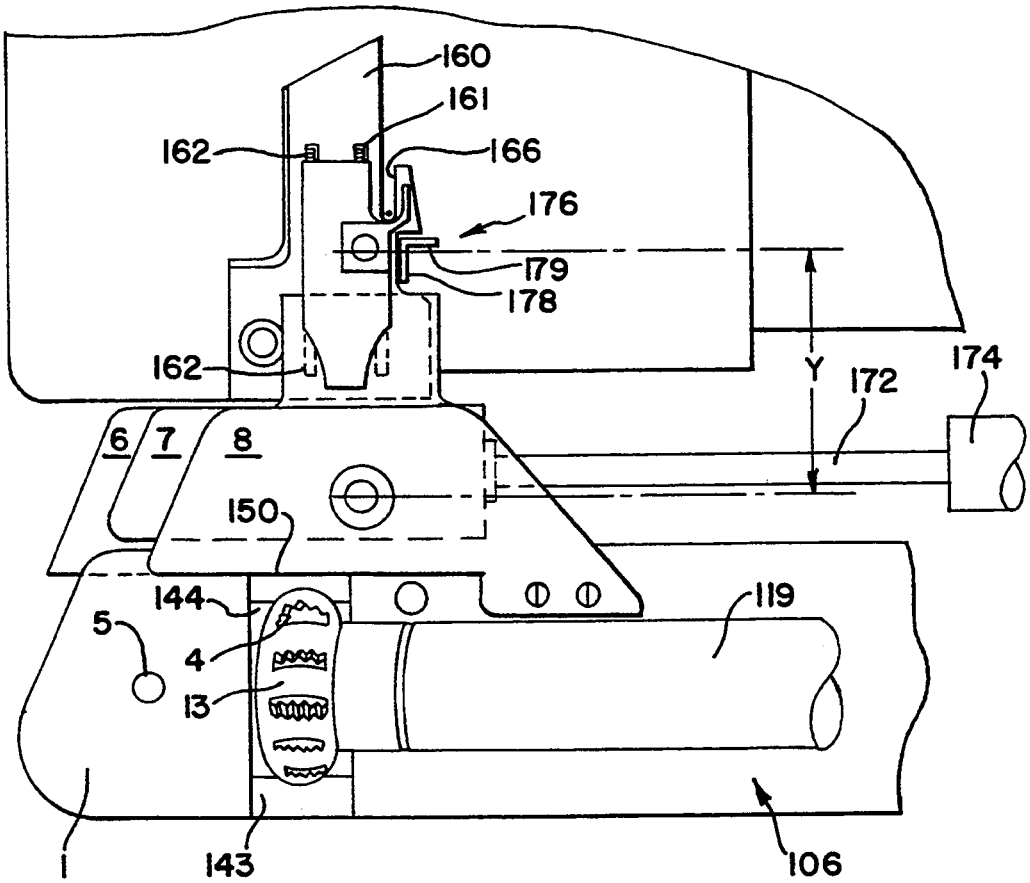
FIG. 5 is a top view of the work surface area of the sewing machine seen in FIG. 1.
Figure 6:
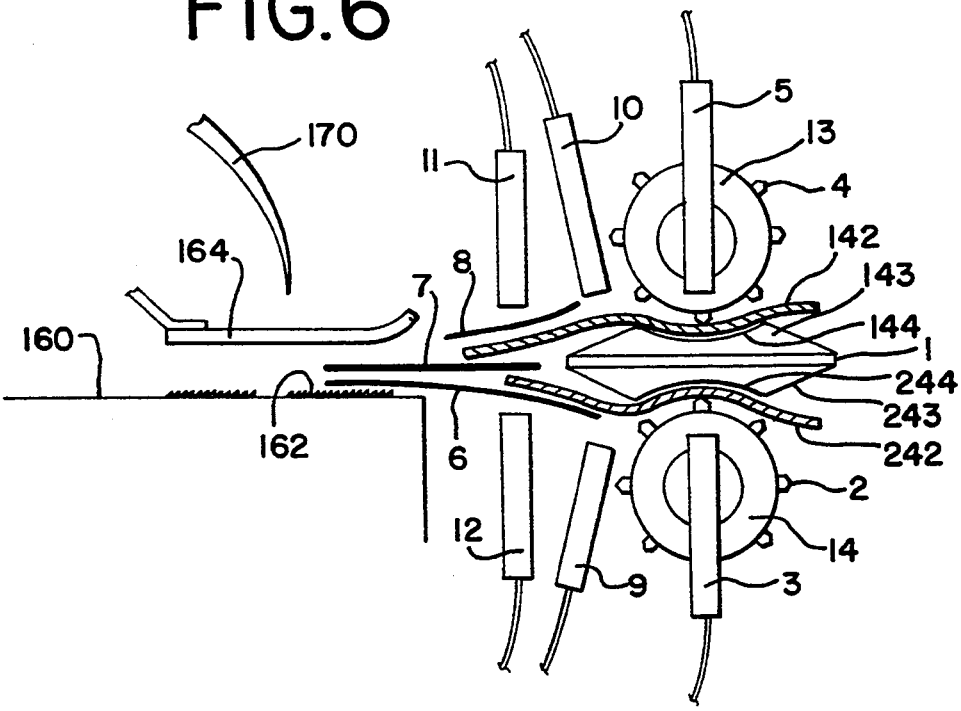
FIG. 6 is a diagrammatic end view illustration of the material loading and stitch forming areas of the sewing machine seen in FIG. 1.

FIG. 5 is a top view of the sewing machine taken along a plane above the pressor foot 164. In this view only the upper edge guiding device 106 is visible. The top feeding wheel 13 with several top gripper wheels 4 are seen, at the free end of hollow shaft 119. The upper edge guiding device 106 overlies the main ply separator plate 1. The feeding wheel 13 is resting on surface 144 of the reaction plate 143. A top ply present sensor or first sensor 5 overlies the main ply separator plate 1. The first ply of material is placed on main ply separator plate 1 and moved to the right until it is under the upper feeding wheel 13. Depending upon the thickness of the ply of material, it may be necessary to raise the feeding wheel 13 by pivoting the upper edge guiding device 106 about its pivot 114. In so placing the first ply of material it passed under the first sensor 5 which recognized that a ply of material is now present and caused the top gripper wheels 4 to be actuated. Top gripper wheels 4 are actuated to rotate in the direction to move the material to the right, as seen in FIG. 5.

The term "margin edge" when used in this patent means the edge of the material that extends along the direction of material feed. The term "leading edge" when used in this patent means the leading edge of the material, that is in most instances, normal to the direction of material feed.

As the gripper wheels 4 move the top ply of material to the right the margin edge of the material approaches the top sensor or second sensor 10. When the second sensor 10 recognizes the margin edge of the top ply of material it causes the drive to the top gripper wheels 4 to be stopped. Thus the movement of the material in the direction lateral to the feed direction stops when the margin edge of the material is located below second sensor 10. Although the movement of the material to the right has been stopped, the top gripper wheels 4 remain under the control of second sensor 10. If the material were to move back to the left, sensor 10 would detect this and cause gripper wheels 4 to move the ply of material to the right until it is returned to its desired location.

When the margin edge of an individual ply of material is recognized by its sensor then the drive to its feeding wheel is actuated. In the example being discussed the drives to upper feeding wheel 13 and bottom feeding wheel 14 are actuated independently to move the materials toward the pressor foot 164 or stitch forming area. During the movement of the material toward the pressor foot 164 movement of the margin edge of the material drifts to the right or left will be detected by sensor 10 and corrected by gripper wheels 4.

A top ply plate 8 includes an edge 150 that overlies the top surface of main ply separator plate 1. As can be best seen in FIG. 6 top ply plate 8 has a slight downward inclination such that it directs the first ply of material toward the surface of the throat plate 160. A retractable sensor plate 7 is immediately below the top ply plate 8. Retractable sensor plate 7 extends horizontally at a level above the throat plate 160 and feed dogs 162. The top ply plate 8 and the retractable sensor plate 7 converge toward the stitch forming area such that the top ply of material is guided below the raised pressor foot 164 and over the leading edges of the feed dogs 162. Between the upper edge guiding device 106 and the stitch forming area is a third upper sensor 11. As the upper feeding wheel 13 is moving the first ply of material and the lower feeding wheel 14 is moving the second ply of material toward the stitch forming area the leading edges of the first and second plies of material are approaching upper third sensor 11 and lower sixth sensor 12. Provided the third 11 and sixth 12 sensors are directed at points at which the first and second plies of material are under the pressor foot 164, the feeding wheels 13 and 14 can be stopped at the point where the leading edge of the material plies is recognized.

However, the stitch forming area in some sewing machines is very congested and it is difficult to locate the third 11 and sixth 12 sensors close to the stitch forming area. In such situations the third 11 and sixth 12 sensors are located such that they recognize the leading edges of the material plies before they reach the stitch forming area. In this situation the following procedure is followed. When the sensors 11 and 12 recognize the leading edges of the first and second plies of material respectively they will cause the upper and lower feeding wheels 13 and 14 to continue to rotate a predetermined number of degrees which will move the material that they are causing to move a predetermined distance. This predetermined distance is such that the leading edges of the first and second plies of material will be located under the raised pressor foot 164 just short of the center line of the needle 170. This predetermined distance is represented as Y in FIG. 5.

Although, in this discussion the first or top ply of material was placed on the main ply separator plate first and then the second or bottom ply of material, this order could be reversed or both could be done simultaneously. It is important to note that each ply of material is aligned and located in the stitch forming area independently of the other plies.

A second or bottom ply of material 242 is placed against the underside of the main ply separator plate 1 moving it to the right such that it passes between the bottom feeder wheel 14 and the undersurface of main ply separator plate 1. It should be noted that the lower edge gripper device 108 is forced upwardly about its pivot axis such that bottom gripper wheels 2 are biased into engagement with surface 244 of reaction plate 243. Reaction plate 243 is secured to the undersurface of main ply separator plate 1. A bottom ply sensor or fourth sensor 3, as seen in FIG. 6, recognizes the presence of the second or bottom ply of material 242. When the fourth sensor 3 recognizes the presence of the second ply of material it causes the bottom gripper wheels 2 to be actuated. Actuation of bottom gripper wheels 2 causes them to rotate in the direction to move the second ply of material to the right, as seen in FIG. 5. As the second ply of material moves to the right its margin edge approaches bottom or fifth sensor 9. When fifth sensor 9 recognizes the margin edge of the second ply of material 242 it causes the bottom gripper wheels 2 to stop rotating and the feeding wheel 14 is actuated to move the second ply of material toward the stitch forming area.

In this example of the invention two plies of material, a first top ply 142 and a second bottom ply 242, having overlying margin edges are stitched together. However, this invention could utilize additional edge guiding devices in an operation where more plies of material are to be sewed together. Also the invention can be used in a sewing operation in which the margin edges of the plies to be sewed together are parallel but offset from each other. It is also contemplated that for some thick materials or difficult to control materials two or more edge guiding devices could be used in series. For example, several edge guiding devices could be aligned one following another such that there are a plurality of gripper and feeding wheels controlling a ply of material.

As the second ply of material is being moved by the bottom feeding wheel 14 in the direction toward the stitch forming area it encounters bottom ply plate 6 which converges with the undersurface of retractable sensor plate 7 to guide the second ply of material over the leading edge of the feed dogs 162 preventing the leading edge from stumbling or rolling up on the sharp teeth of the feed dog. After the sixth sensor 12 recognizes the leading edge of the second ply of material, the bottom feeding wheel 14 continues to move the second ply of material a predetermined distance Y. When the leading edges of all plies of material, that are to be stitched together, have been advanced distance Y past the last of the sensors, the retractable sensor plate 7 and bottom ply plate 6 are withdrawn and then the pressor foot 164 is lowered and the sewing operation commences. It is important to note that each ply of material is processed independently until it has been located in its proper relationship in the stitch forming area.

As best seen in FIG. 5 the rod 172 of an air cylinder 174 is connected to the right edges of plates 6 and 7. When air cylinder 174 is contracted the plates 6 and 7 are withdrawn from between the overlapped plies of material. The sewing operation is then commenced. The upper and lower edge guiding devices 106 and 108 respectively continue to operate during the sewing operation. The top 4 and bottom 2 gripper wheel function to maintain the first and second plies of material in proper edge alignment while the top 13 and bottom 14 feeding wheels function to feed the material along the line of material feed at a uniform rate that is coordinated with the feed rate of the stitch forming mechanism.

As best seen in FIG. 5 the top surface of the sewing machine includes a throat plate 160 including slots 161 through which feed dog elements 162 project. Throat plate 160 also includes a slot 166 through which the needle 170 moves. In FIG. 6 the needle 170 is illustrated as arcuate shaped however this invention can also be used with sewing machines using straight needles. On the right hand side of the throat plate 160 (FIG. 5) an edge trimmer 176 is shown. The edge trimmer 176 includes a lower fixed knife 178 and an upper moveable trim knife 179. The use of the edge trimmer 176 is optional.

Figure 7:
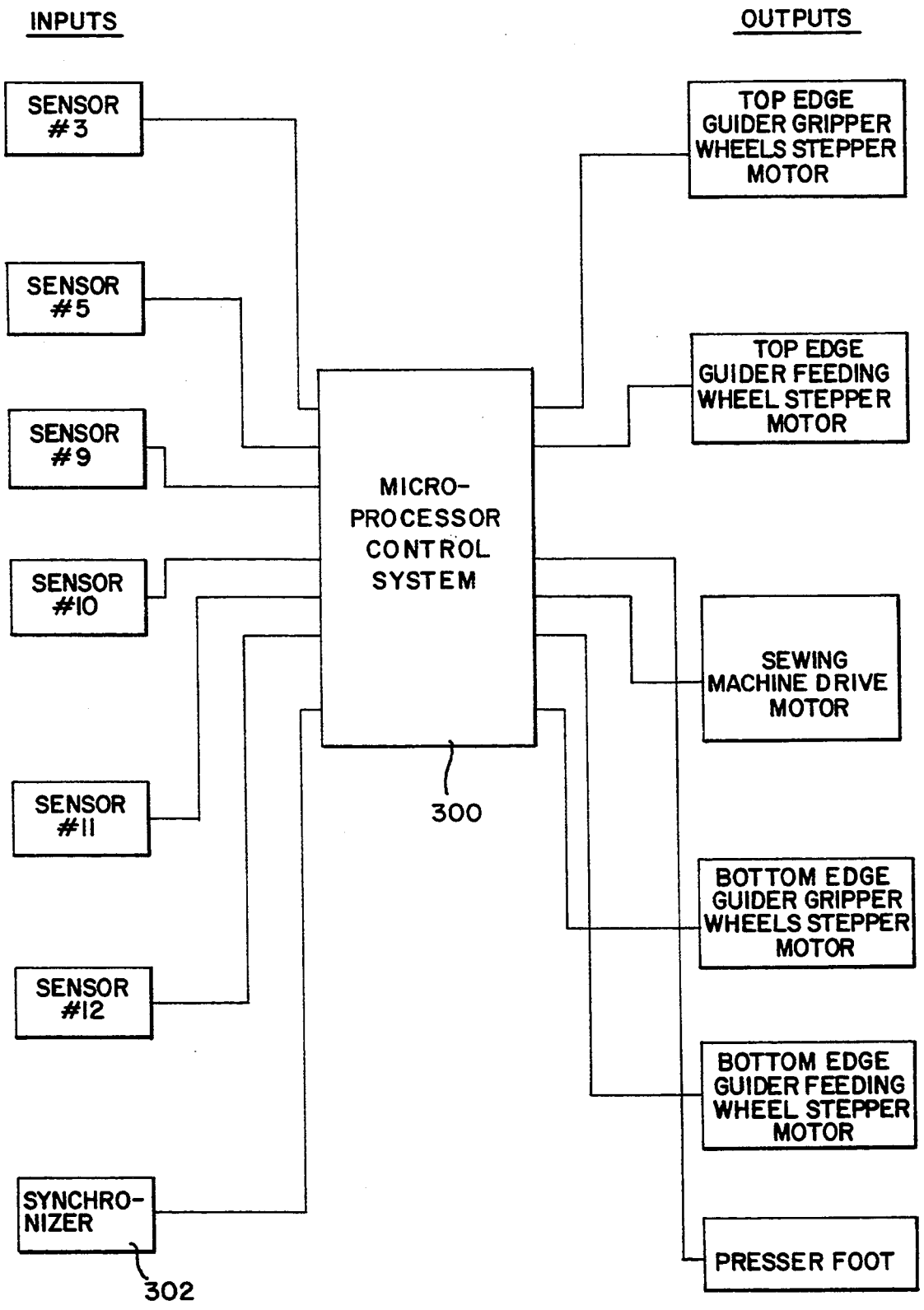
FIG. 7 is a block diagram of the control system for the automatic ply aligning and positioning mechanism.

Referring now to FIG. 7 the control system for the device of this invention will be discussed. A synchronizer 302 sends a signal, which indicates the speed at which the stitch forming mechanism of the sewing machine is operating, to the micro processor control system 300. This data is important to the proper operation of edge guiding device because the feeding wheels 13 and 14 must be synchronized with the stitch forming mechanism of the sewing machine. The sensors 3, 5, 9, 10, 11 and 12 each transmit signals to the micro processor control system 300. The signal being transmitted by the sensors changes when a sensor detects the presence of a ply of material. The micro processor is programmed to respond to the changes in the signals that it receives from the sensors by sending operating instructions to various components of the sewing machine and the device for automatically aligning and positioning the plies of material. The micro processor is programmed, for example, in response to a signal from sensor 10 that it has recognized the margin edge of material ply 142, to transmit a signal to the stepper motor 110 to advance or rotate a certain number of steps which will cause the feeder wheel 13 to move the upper ply of material 142 a predetermined distance toward the stitch forming area. This distance can be changed by reprogramming the micro processor. The micro processor control system 300 receives signals from sensors during the sewing operation which it processes and sends appropriate signals to the edge guiding devices to automatically guide the plies of material being stitched and feed them at the appropriate rate.

It is intended that the accompanying drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. A method of automatically aligning the margin and leading edges of multiple plies of material as the multiple plies of material are fed in the direction of feed from a main separation plate in the loading area to a stitch forming location of a sewing machine, the sewing machine being of the type in which the sewing operation is performed by stitch forming mechanism that include a pressor foot and a sewing needle and in which the speed of the sewing operation can be varied, comprising the steps of:

(a) providing first and fourth sensors that have viewing areas within the loading area;

(b) loading a first ply of material to be sewed into the loading area such that the first ply of material is in the viewing area of a first sensor;

(c) actuating first ply gripper wheels in response to the first sensor having recognized the presence of the first ply of material in the loading area;

(d) transposing the first ply of material in the direction normal to the direction of feed and toward a second sensor;

(e) sensing the margin edge of the first ply of material with the second sensor when the first ply of material arrives at a preselected location relative to the line of feed;

(f) stopping the gripper wheels in response to sensing the margin edge of the first ply of material's arrival at the preselected location;

(g) loading a second ply of material to be sewed into the loading area such that the second ply of material is in the viewing area of a fourth sensor;

(h) actuating second ply gripper wheels in response to the fourth sensor having recognized the presence of the second ply of material in the loading area;

(i) transposing the second ply of material in the direction normal to the direction of feed and toward a fifth sensor;

(j) sensing the margin edge of the second ply of material with the fifth sensor when it arrives at a preselected location relative to the line of feed;

(k) stopping the second ply gripper wheels in response to sensing the margin edge of the second ply of material's arrival at the preselected location;

(l) actuating first and second ply feeding wheels that function to feed the first and second plies of material in the direction toward the sewing needle;

(m) sensing the leading edges of the first and second ply of material with third and sixth sensors when the leading edges arrive at a preselected location relative to the sewing needle;

(n) stopping the independent operation of the first and second ply feeding wheels in response to recognizing the leading edges of said first and second plies;

(o) lowering the presser foot; and (p) commencing the sewing operation.

2. The invention as set forth in claim 1 wherein after step (n) and before step (o) the following steps are performed:

(q) providing a retractable sensor plate that is located between the first and second plies of material;

(r) retracting said retractable sensor plate from between the first and second plies of material.

3. The invention as set forth in claim 1 wherein after step (n) and before step (o) the following steps are performed:

(q) providing a retractable sensor plate that is located between the first and second plies of material;

(r) provide a retractable bottom ply plate that is in engagement with the second ply of material;

(s) retracting said retractable sensor plate from engagement with the first ply of material;

(t) retracting said retractable bottom ply plate from engagement with the second ply of material.

4. The invention as set forth in claim 1 wherein additional plies of material are independently and automatically aligned for the sewing operation by providing additional sets of gripper wheels, feeding wheels and sensors.

5. The invention as set forth in claim 1 wherein after step (p) the following steps are performed:

(q) continuing the operation of the first and second ply gripper wheels;

(r) controlling the first and second ply gripper wheels in response to the second and fifth sensors to thereby maintain the alignment of the margin edges of the first and second plies of material during the sewing operation;

(s) sensing the speed of the sewing machine stitch forming mechanism;

(t) continuing the operation of the first and second ply feeding wheels;

(u) synchronizing the speed of the first and second ply feeding wheels with the speed of the sewing machine stitch forming mechanism to thereby maintain the feed of the first and second plies of material at a rate corresponding to the sewing machine operation.

6. The invention as set forth in claim 1 wherein after step (m) the following step is performed:

(x) continuing the independent operation of the first and second ply feeding wheels until the leading edges of first and second plies of material are each located a preselected distance, in the direction toward the sewing needle, from where the leading edges were initially sensed by the third and sixth sensors.

7. A sewing machine having a stitch forming location and a device for automatically aligning the margin and leading edges of a first work ply of material to be sewed, and locating the aligned plies at the stitch forming location comprising:

a first sensor arrangement for detecting the presence of a first work piece ply;

a power driven gripper wheel, in engagement with said first work piece ply, that is actuated in response to said first sensor detecting the presence of a work piece ply;

said power driven gripper wheel being oriented to move said first work piece ply toward a second sensor that detects said first work ply's margin edge;

when said second sensor, detects the margin edge of said first work piece ply, it stops said power driven gripper wheel;

a power driven feeding wheel, in engagement with said first work piece ply, that is actuated in response to the power driven gripper wheel being stopped;

said power driven feeding wheel being oriented to move said first work piece in the direction of feed toward the stitch forming location;

a third sensor located to detect the leading edge of said first ply of material, as said first ply of material approaches the stitch forming location;

said power driven feeding wheel stopping movement of said first work piece in response to said third sensor recognizing the leading edge of said first work piece;

control means for commencing the sewing operation when all plies to be sewed have been located and stopped at the stitch forming location.

8. The invention as set forth in claim 7 wherein said gripper wheel is one of a plurality of gripper wheels that are disposed around the circumference of said feeding wheel, said gripper wheels being angularly disposed with respect to the feeding wheel in order to move a work piece ply angularly with respect to the feed direction prescribed by the feeding wheel.

9. A device as claimed in claim 8, in which said gripper wheels are disposed transversely to the feed direction and the feeding wheel is disposed in the same direction as the feed direction.

10. The invention as set forth in claim 7 wherein after the sewing operation has commenced said second sensor functions to automatically control the alignment of the margin edge of said first work piece ply.

11. The invention as set forth in claim 7, wherein the invention further comprises:

a fourth sensor arrangement for detecting the presence of a second work piece ply;

a power driven gripper wheel, in engagement with said second work piece ply, that is actuated in response to said fourth sensor detecting the presence of a work piece ply;

said power driven gripper wheel being oriented to move said second work piece ply toward a fifth sensor that detects the margin edge of said second work piece;

when said fifth sensor, detects the margin edge of said second work piece ply, said power driven gripper wheel is stopped;

a power driven feeding wheel, in engagement with said second work piece ply, that is actuated in response to the stopping of said power driven gripper wheel;

said power driven feeding wheel being oriented to move said second work piece ply in the direction of feed toward the stitch forming location;

a sixth sensor located to detect the leading edge of said second ply of material as said second ply of material approaches the stitch forming location;

said power driven feeding wheel stopping movement of said second work piece ply in response to said sixth sensor recognizing the leading edge of said second work piece ply.

12. The invention as set forth in claim 11 wherein after the sewing operation has commenced said second and fifth sensors function to automatically control the alignment of the margin edge of said first and second work piece plies respectfully.

13. The invention as set forth in claim 7 in which said power driven feeding wheel continues to move said first work piece a given distance, toward the stitch forming location, past where the third sensor detected the presence of the leading edge of said first work piece ply.

14. The invention as set forth in claim 8 in which said power driven feeding wheel continues to move said second work piece a given distance, toward the stitch forming location, past where the sixth sensor detected the presence of the leading edge of said second work piece ply.

15. A method of automatically aligning the margin and leading edges of a ply of material as the ply of material is fed in the direction of feed from a main separation plate in the loading area to a stitch forming location of a sewing machine, the sewing machine being of the type in which the sewing operation is performed by stitch forming mechanism that include a pressor foot and a sewing needle and in which the speed of the sewing operation can be varied, comprising the steps of:

(a) providing a first sensor that has a viewing area within the loading area;

(b) loading the ply of material to be sewed into the loading area such that the first ply of material is in the viewing area of a first sensor;

(c) actuating a ply gripper wheel in response to the first sensor having recognized the presence of the ply of material in the loading area;

(d) transposing the ply of material in the direction normal to the direction of feed and toward a second sensor;

(e) sensing the margin edge of the ply of material with the second sensor when said margin edge of the ply of material arrives at a preselected location relative to the line of feed;

(f) stopping the gripper wheels in response to sensing the margin edge of the ply of material's arrival at the preselected location;

(g) actuating a ply feeding wheel that functions to feed the ply of material in the direction toward the sewing needle;

(h) sensing the leading edge of the ply of material with a third sensor when the leading edge arrives at a preselected location relative to the sewing needle;

(i) stopping the operation of the ply feeding wheel in response to said third sensor recognizing the leading edge of the ply of material;

(j) lowering the presser foot; and (k) commencing the sewing operation.

16. The invention as set forth in claim 15 wherein after step (i) and before step (j) the following steps are performed:

(l) providing a retractable sensor plate that is in engagement with the ply of material;

(m) retracting said retractable sensor plate that was in engagement with the ply of material.

17. The invention as set forth in claim 15 wherein additional plies of material are independently and automatically aligned for the sewing operation by providing additional sets of gripper wheels, feeding wheels and sensors.

18. The invention as set forth in claim 15 wherein after step (k) the following steps are performed:

(n) continuing the operation of the ply gripper wheels;

(o) controlling the ply gripper wheels in response to the second sensors to thereby maintain the alignment of the margin edge of the ply of material during the sewing operation;

(p) sensing the speed of the sewing machine stitch forming mechanism;

(q) continuing the operation of the ply feeding wheel;

(r) synchronizing the speed of the ply feeding wheel with the speed of the sewing machine stitch forming mechanism to thereby maintain the feed of ply of material at a rate corresponding to the sewing machine operation.

19. The invention as set forth in claim 15 in which after step (h) and before step (i) the following step is performed:

(s) continuing the operation of the ply feeding wheel until the leading edge of the ply of material is located a preselected distance, in the direction toward the sewing needle, from where initial sensing of the leading edge by the third sensor occurred.

20. A sewing machine having a stitch forming location and a device for automatically aligning the margin and leading edges of a ply of material to be sewed, and locating the aligned ply at the stitch forming location comprising:

a first sensor arrangement for detecting the presence of a work piece ply;

a power driven gripper wheel, in engagement with said work piece ply, that is actuated in response to said first sensor detecting the presence of the work piece ply;

said power driven gripper wheel being oriented to move said work piece ply toward a second sensor that detects the margin edge of said work piece ply;

when said second sensor, detects the margin edge of said work piece ply, said power driven gripper wheel is stopped;

a power driven feeding wheel, in engagement with said work piece ply, that is actuated in response to the stopping of said power driven gripper wheel;

said power driven feeding wheel being oriented to move said work piece in the direction of feed toward the stitch forming location;

a third sensor located to detect the leading edge of said ply of material, as said ply of material approaches the stitch forming location, at a given distance from the stitch forming location;

said power driven feeding wheel continuing to move said first work piece a distance equal to said given distance, toward the stitch forming location, and stopping its movement of said work piece when said first work piece has been moved said given distance from the point where the third sensor detected the presence of the leading edge of said work piece ply;

control means for commencing the sewing operation when the ply of material to be sewed has been located and stopped at the stitch forming location.

21. The invention as set forth in claim 20 wherein said gripper wheel is one of a plurality of gripper wheels that are disposed around the circumference of said feeding wheel, said gripper wheels being angularly disposed with respect to the feeding wheel in order to move the work piece ply angularly with respect to the feed direction prescribed by the feeding wheel.

22. The invention as set forth in claim 20 wherein after the sewing operation has commenced said second sensor functions to automatically control the alignment of the margin edge of said work piece ply.

23. A device as claimed in claim 20, in which said gripper wheels are disposed transversely to the feed direction and the feeding wheel is disposed in the same direction as the feed direction.

* * * * *